United States Patent [19]

Oztekin et al.

[11] 4,294,363

[45] Oct. 13, 1981

[54] MERCHANDISE SHELVING DISPLAY

[75] Inventors: Muammer A. Oztekin; Vincent J. Albano, both of Birmingham, Ala.

[73] Assignee: The Kent Corporation, Birmingham, Ala.

[21] Appl. No.: 104,192

[22] Filed: Dec. 17, 1979

[51] Int. Cl.[3] ..... A47F 1/00

[52] U.S. Cl. ..... 211/49 D; 193/38

[58] Field of Search ..... 211/49 D, 162, 135; 193/2 R, 2 D, 38

[56] References Cited

U.S. PATENT DOCUMENTS

| | | | |
|---|---|---|---|
| 2,218,444 | 10/1940 | Vineyard | 211/49 D |
| 2,652,154 | 9/1953 | Stevens | 211/49 D |
| 3,064,783 | 11/1962 | McClelland | 193/38 |
| 3,091,317 | 5/1963 | Just | 193/38 |
| 3,499,539 | 3/1970 | Fisher | 211/49 D |
| 4,119,208 | 10/1978 | Acker | 211/162 |

*Primary Examiner*—Roy D. Frazier
*Assistant Examiner*—Robert W. Gibson, Jr.
*Attorney, Agent, or Firm*—Woodford R. Thompson, Jr.

[57] ABSTRACT

A merchandise shelving display embodying a downwardly inclined shelf panel supported from a supporting frame. At least one downwardly inclined track unit is integrally formed to provide a pair of upstanding outer rails extending in spaced parallel relation to each other and a pair of upstanding inner rails between the outer rails and extending in spaced parallel relation to each other and the outer rails with the upper surfaces of the outer rails being at an elevation different from the elevation of the upper surfaces of the inner rails. Each track unit is detachably secured to the upper surface of the shelf panel so that a plurality of laterally spaced track units may be carried by the shelf panel.

3 Claims, 7 Drawing Figures

MERCHANDISE SHELVING DISPLAY

BACKGROUND OF THE INVENTION

This invention relates to a merchandise shelving display and more particularly to such a display which shall include improved means for moving merchandise to the lower end of the shelving whereby merchandise may be readily removed therefrom by a shopper with a minimum of effort and at the same time the merchandise is placed in plain view of the shopper.

Heretofore in the art to which our invention relates, various type gravity fed shelving displays have been proposed whereby the containers for goods are automatically moved toward the lower end of the shelving display. Such shelving displays have included complicated mechanism, such as endless belts, rollers and the like which support the articles to be displayed. Also, sloping surfaces have been provided for supporting the articles being displayed. However, difficulties have been encountered in controlling the rate of movement of the containers down such sloping surfaces. To increase the rate of movement of articles down inclined shelving units, such shelving units have been tilted at a greater angle. This has proven to be unsatisfactory due to the fact that by increasing the angle at which the shelving slopes, the overall storage space for the articles is greatly reduced and at the same time the articles cannot be viewed by the customer.

SUMMARY OF THE INVENTION

In accordance with our invention, we provide a merchandise shelving display which includes a downwardly inclined shelf panel which supports at least one downwardly inclined track unit which is integrally formed of a common sheet of material or extruded plastics to provide a pair of upstanding outer rails extending in spaced parallel relation to each other and a pair of inner rails located intermediate the outer rails and extending in spaced relation to each other and to the outer rails. The upper surfaces of the outer rails are at an elevation different from the elevation of the upper surfaces of the inner rails whereby the two inner rails serve as guides to prevent tilting while the outer rails provide the slide action required and vice versa.

Our improved merchandise shelving display is particularly adapted for use in handling products such as soft drinks, canned materials, such as paints and hardware merchandise and the like. An object of our invention is to provide a merchandise shelving display of the character designated which provides a common surface to fit a multitude of products of various sizes, shapes and weights and at the same time provides improved means which prevents the product from tilting.

Another object of our invention is to provide a merchandise shelving display wherein the co-efficient of friction is lowered to permit the product to move under its own weight and at the same time eliminate the necessity of having to tilt the shelving down too far so as to reduce storage space. Also, our improved merchandise shelving display maintains a uniform and constant product speed for a multitude of products of various weights and sizes.

DESCRIPTION OF THE DRAWINGS

A merchandise shelving display embodying features of our invention is illustrated in the accompanying drawings, forming a part of this application, in which.

DETAILED DESCRIPTION

Figure 1:
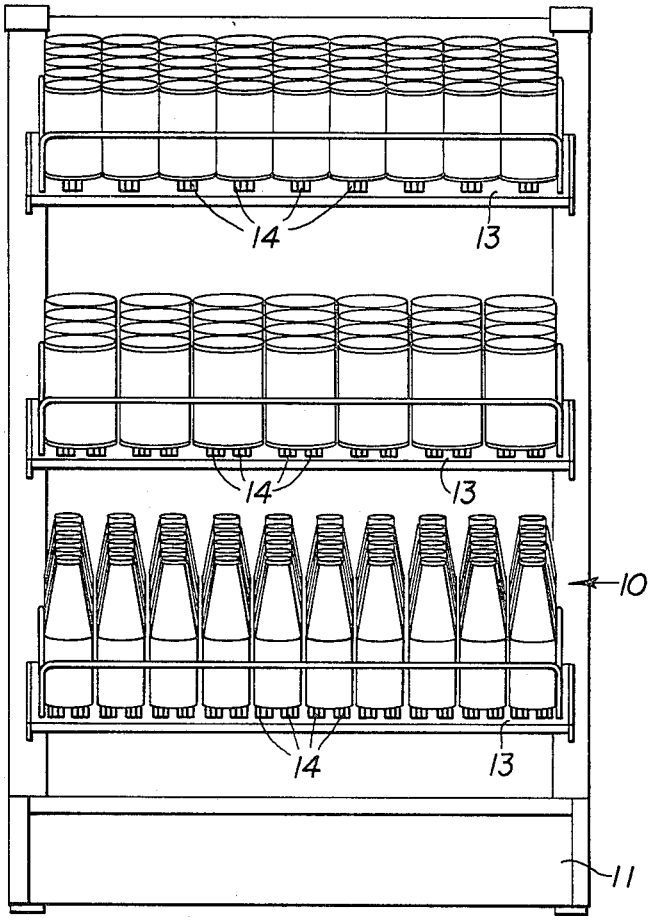
FIG. 1 is a front elevational view of our improved merchandise shelving display.
Figure 2:
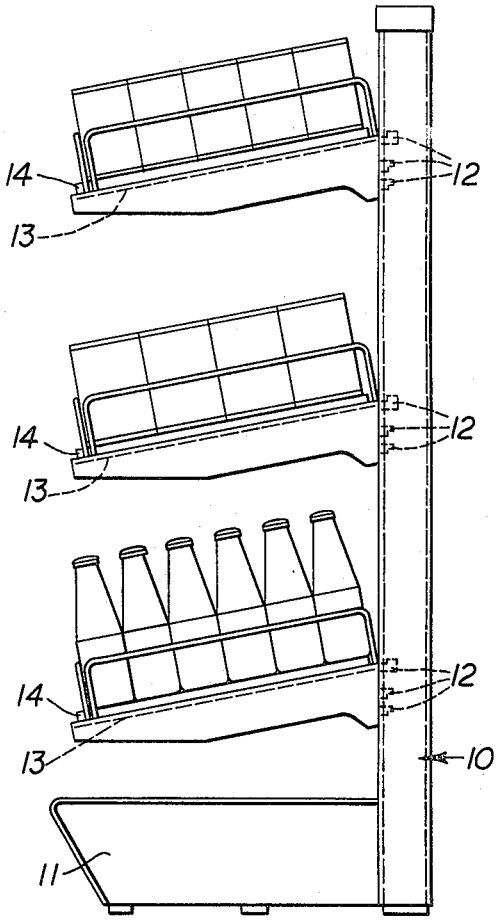
FIG. 2 is a side elevational view thereof.

Referring now to the drawings for a better understanding of our invention, our improved shelving display is shown as having a supporting frame 10 having a base section 11 at the lower end thereof. Detachably connected to the supporting frame 10 by conventional attaching units 12 are a plurality of downwardly and forwardly inclined shelf panels 13 which are in vertically spaced relation to each other, as clearly shown in FIGS. 1 and 2.

Figure 3:
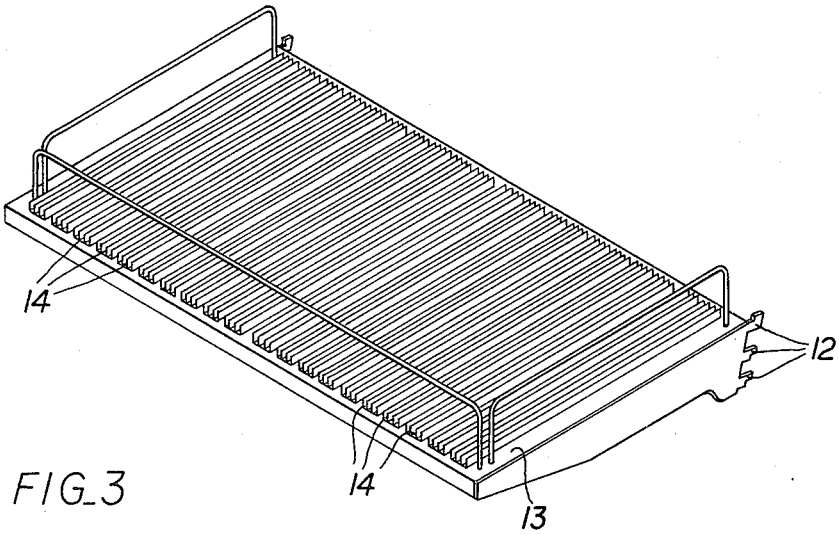
FIG. 3 is a perspective view showing one shelf panel having our improved track units thereon and removed from the remainder of the display.
Figure 4:
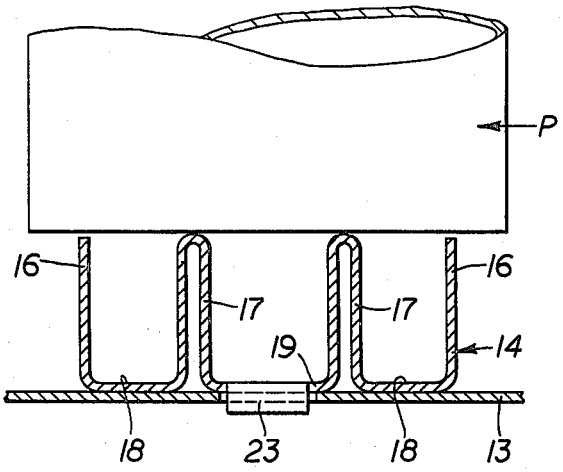
FIG. 4 is a transverse sectional view through one of the track units shown in FIGS. 1–3.

As shown in FIG. 3, a plurality of downwardly inclined track units 14 are carried by the upper surface of each shelf panel 13. As clearly shown in FIG. 4, each track unit 14 is integrally formed from a common sheet of material, such as metal, or may be extruded from plastic or the like, and comprises a pair of upstanding outer rails 16 which extend in spaced parallel relation to each other. A pair of upstanding inner rails 17 are formed between the outer rails 16 and extend in spaced parallel relation to each other and in parallel relation to outer rails 16. The upper surfaces of the outer rails 16 are at an elevation below the elevation of the upper surfaces of the inner rails 17 whereby the upper surfaces of the outer rails are at a different elevation from the elevation of the upper surfaces of the inner rails. Accordingly, the track unit is provided with four rail surfaces which are in spaced parallel relation to each other so as to minimize the contact surface between the merchandise and the rails to thereby reduce the coefficient of friction therebetween. In addition to reducing the frictional contact between the merchandise and the rails, the two inner rails act as guides to prevent tilting of the product being displayed while the outer rails provide for the sliding action required to move the product to the front of the shelving and vice versa. As clearly shown in FIG. 4, the outer rails and inner rails may be formed from a common sheet of material with each outer rails 16 being defined by an upstanding flange connected to the lower portions of the inner rails 17 adjacent thereto by a base portion 18. The inner rails 17 are connected to each other by a base member 19 with each inner rail 17 being defined by upstanding flanges joined to each other at the upper ends thereof and joined at their lower ends to the base member 19, as shown. The upstanding flanges forming the inner rails 17 are joined to each other to provide a top surface for each inner rail 17 which is struck on a radius, as shown in FIG. 4, to provide a convexly curved upper surface for the inner rails 17. The upper surfaces of the outer rails 16 may be flat, as shown in FIG. 4.

Figure 5:
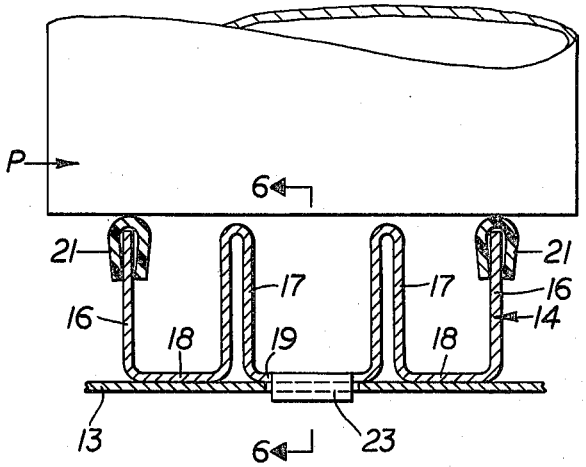
FIG. 5 is a transverse sectional view through a modified form of track unit and taken generally along the line 5—5 of FIG. 6.
Figure 6:
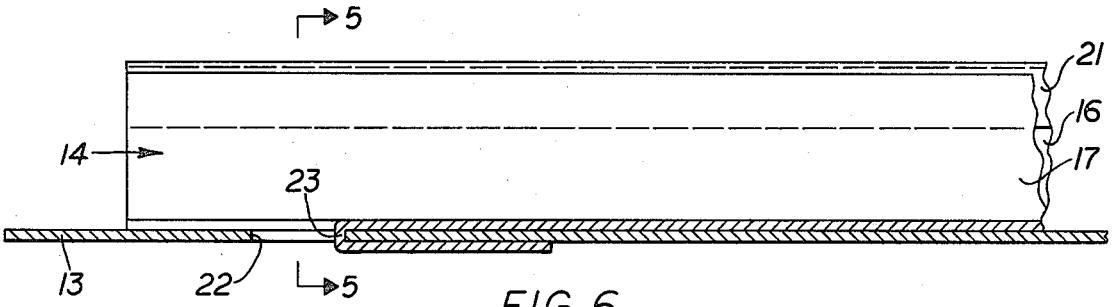
FIG. 6 is a sectional view taken generally along the line 6—6 of FIG. 5; and, FIG. 7 is a fragmental, perspective view showing the track unit illustrated in FIGS. 5 and 6.
Figure 7:
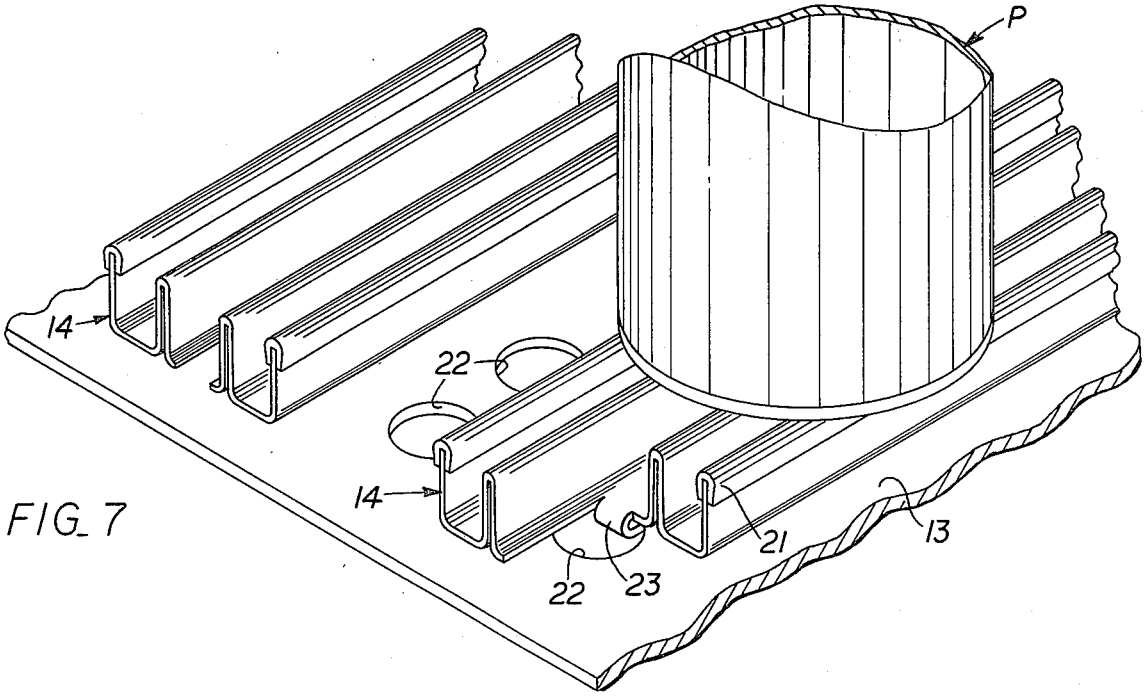

As shown in FIGS. 5, 6 and 7, elongated guide rails 21 of a generally inverted U-shape, as viewed in cross section, may be detachably mounted on each of the outer rails 14 to vary selectively the height and width of the outer rails. That is, by providing the elongated guide rails 21 along the upper edges of the outer rails 14, the overall height of the outer rails 14 is increased whereby the upper surfaces of the outer rails 14 are at an elevation above the upper surfaces of the inner rails 17. Also, the elongated guide rails 21 increase the area of contact between the product being displayed, indicated generally at P, and the subjacent guide rails 21. It will thus be seen that the co-efficient of friction between the outer rails and the product P can be readily varied by varying the shape and size of the elongated guide rails 21. That is, instead of providing guide rails 21 having an upper, convexly curved surface, the guide rails 21 may be generally flat or of other suitable shapes. Preferably, the guide rails 21 are of a shape and size whereby they are adapted to snap over the tops of the guide rails 14, as shown in FIG. 5.

A plurality of laterally spaced openings 22 are provided in the shelf panel 13 which are adapted to receive depending catch elements 23 carried by the base member 19 of each of the track units, as shown. That is, the depending catch element 23 is in position to engage selected ones of the openings 22 to detachably connect the track unit to the shelf panel. Also, as shown in FIG. 6, each of the depending catch elements 23 is in the form of a bendable tab which extends through one of the openings 22 and is bent to secure the track unit to the shelf panel 13.

From the foregoing, it will be seen that we have devised an improved gravity actuated merchandise shelving display which assures that the merchandise moves automatically to the lower end or front of the shelving of the display stand each time the frontmost article of merchandise is removed whereby the frontmost article is in clear view of the shopper and at the same time may be readily removed from the shelving. Also, by providing a plurality of downwardly inclined track units with each track unit comprising inner and outer pairs of upstanding rails, we provide supporting surfaces for the products of merchandise which are adapted to accommodate a plurality of products of various sizes and weights and at the same time eliminate tilting of the products. Furthermore, by lowering and controlling the coefficient of friction between the product and the track units, the product moves at a uniform speed and under its own weight without the necessity of having to tilt the shelving downward too far which would result in the loss of storage space.

While we have shown our invention in two forms, it will be obvious to those skilled in the art that it is not so limited, but is susceptible of various other changes and modifications without departing from the spirit thereof.

What we claim is:

1. In a merchandise shelving display having at least one downwardly inclined shelf panel supported from a supporting frame, (a) at least one downwardly inclined track unit integrally formed and having a pair of upstanding outer rails extending in spaced parallel relation to each other and a pair of upstanding inner rails between said outer rails and extending in spaced parallel relation to each other and said outer rails with the upper surfaces of said outer rails being at an elevation below the elevation of the upper surfaces of said inner rails, and (b) means securing said track unit to the upper surface of said shelf panel.

2. A merchandise shelving display as defined in claim 1 in which elongated guide rails of a generally inverted U-shape as viewed in cross section are detachably mounted on said outer rails to vary selectively the height and width of said outer rails.

3. A merchandise shelving display as defined in claim 2 in which each said elongated guide rail is adapted to snap over the top of an outer rail.

* * * * *